US005518480A

United States Patent [19]

Frappier

[11] Patent Number: 5,518,480

[45] Date of Patent: May 21, 1996

[54] ARM TRAINING DEVICE

[75] Inventor: John P. Frappier, Horace, N. Dak.

[73] Assignee: Acceleration Products, Inc., Fargo, N. Dak.

[21] Appl. No.: 294,627

[22] Filed: Aug. 23, 1994

[51] Int. Cl.[6] ..... A63B 21/02

[52] U.S. Cl. ..... 482/124; 482/139; 482/129; 482/43

[58] Field of Search ..... 482/121, 122, 482/124, 43, 129, 126, 139; 273/189 R, 26 C, 29 A, DIG. 19

[56] References Cited

U.S. PATENT DOCUMENTS

| | | | |
|---|---|---|---|
| 4,544,155 | 10/1985 | Wallenbrock et al. | 482/139 |
| 4,718,665 | 1/1988 | Airy et al. | 482/139 |
| 4,978,119 | 12/1990 | Hull . | |
| 5,002,275 | 3/1991 | Beutler et al. . | |
| 5,096,190 | 3/1992 | Montgomery . | |
| 5,167,601 | 12/1992 | Frappier . | |
| 5,186,701 | 2/1993 | Wilkinson | 482/124 |

*Primary Examiner*—Lynne A. Reichard
*Attorney, Agent, or Firm*—Faegre & Benson

[57] ABSTRACT

An arm training device comprises a resilient and extensible tether, a set of bindings for the upper and lower arm, such that the set of bindings is connected to each other and to a tether. The other end of the tether is then connected to a restraint means which provides resistance for the arm moving or exerting motion away from restraint means. In one embodiment, particularly suitable for development of both arms, two sets of arm bindings are provided for attachment to upper and lower parts of both arms and the tethers of each set of arm bindings are then attached to a belt to be worn about the waist. In another embodiment, a single set of arm bindings is provided for attachment to upper and lower parts of the one involved arm, and the opposite end of the tether is provided with a loop or similar means for attachment to a stationary source of resistance or to be held by the trainer.

15 Claims, 2 Drawing Sheets

ARM TRAINING DEVICE

FIELD OF THE INVENTION

This invention relates to a device for strengthening and training the muscle system of the arm and upper body. Alternative embodiments of the present device may be used for developing the muscle system of one or both arms and the related upper body area. The device is suitable for use in connection with a number of sports, including aquatic sports (swimming, canoeing, sculling, etc.), games using balls or similar projectiles (baseball, football, basketball, etc.), and various sports involving throwing or lofting skills (javelin, discus, shot put, etc.), and also in connection with general development and rehabilitation of the arm and related upper body musculature.

BACKGROUND OF THE INVENTION

Previous anatomical study and training work with running athletes conducted by the present inventor resulted in the development of a SPRINTER LEG MUSCLE TRAINING DEVICE, described and claimed in this inventor's prior U.S. Pat. No. 5,167,601, issued Dec. 1, 1992. Related work and study has been extended by the present inventor with various other athletes in sports requiring specific development of the arm and related upper body musculature. This research indicates that certain identifiable arm and related upper body muscles, particularly the trapezius, deltoid, pectoral and latissimus dorsi muscles of the upper body and the biceps, triceps and quadriceps muscles of the arm, require specialized strengthening and training to achieve maximum strength, agility and effectiveness, and/or to recover from injury. In the course of this continuing study and work, this inventor has developed a novel device for training and strengthening these muscle groups that is particularly effective in the above recited sports and in related activities requiring development of arm strength, and of extension and throwing motions to improve overall performance.

In sports involving throwing, although the biomechanics vary from one sport to another, there is a commonality shared among all throwing motions. Each begins with a gentle wind-up before the shoulder structures are "cocked" to provide a tense, highly forceful unit ready for an accelerated release. Once the projectile is released, the athlete "follows through" to prevent injury associated with internal forces.

One major problem with current training devices is their inability to approach speeds that body segments actually undergo during the act of throwing. One study has shown that internal rotation occurs at speeds of up to 7300 degrees per second and elbow extension occurs at 2300 degrees per second. These rapid accelerations cannot be reproduced on traditional weight training equipment. In addition, it has been shown that motor tasks become more dissimilar at different velocities and require distinct patterns of neuromuscular recruitment and coordination. Therefore, an athlete should not train slowly for a skill that is ballistic in nature. Therefore, there is a recognized need for an arm training device which will provide high speed, sport specific acceleration and eccentric loading of an athlete's entire kinetic chain.

SUMMARY OF THE INVENTION

The present invention provides an arm training device which comprises a set of bindings for the upper and lower arm, such that the set of bindings is connected to each other and to a first end of a resilient and extensible tether. The other end of the tether is then connected to a restraint means which provides resistance for the arm moving or exerting motion away from restraint means. Various embodiments of the device are suitable for various sports or training and strengthening activities.

In one embodiment, particularly suitable for development of both arms for swimming, canoeing, rowing, sculling, etc., two sets of arm bindings are provided for attachment to upper and lower parts of both arms and the tethers of each set of arm bindings are then attached to a belt to be worn about the waist. In another embodiment, particularly suitable for development of a single arm for sports requiring throwing or lofting motions, a single set of arm bindings is provided for attachment to upper and lower parts of the involved arm, and the opposite end of the tether is provided with a loop or similar means for attachment to a stationary source of resistance or to be held by a trainer.

DETAILED DESCRIPTION OF THE INVENTION

Figure 1:
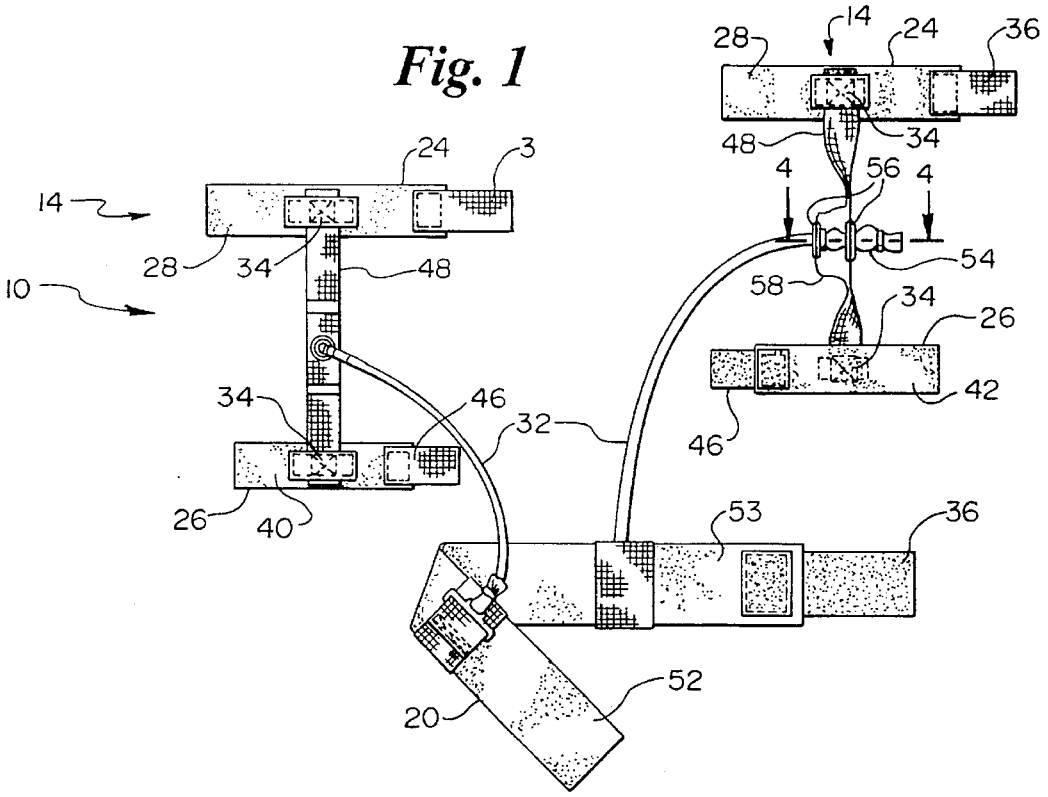
FIG. 1 is a perspective view of a device of the present invention to be worn entirely by the subject, showing structural elements of arm bands for attachment to the arms and a belt for attachment to the waist.
Figure 2:
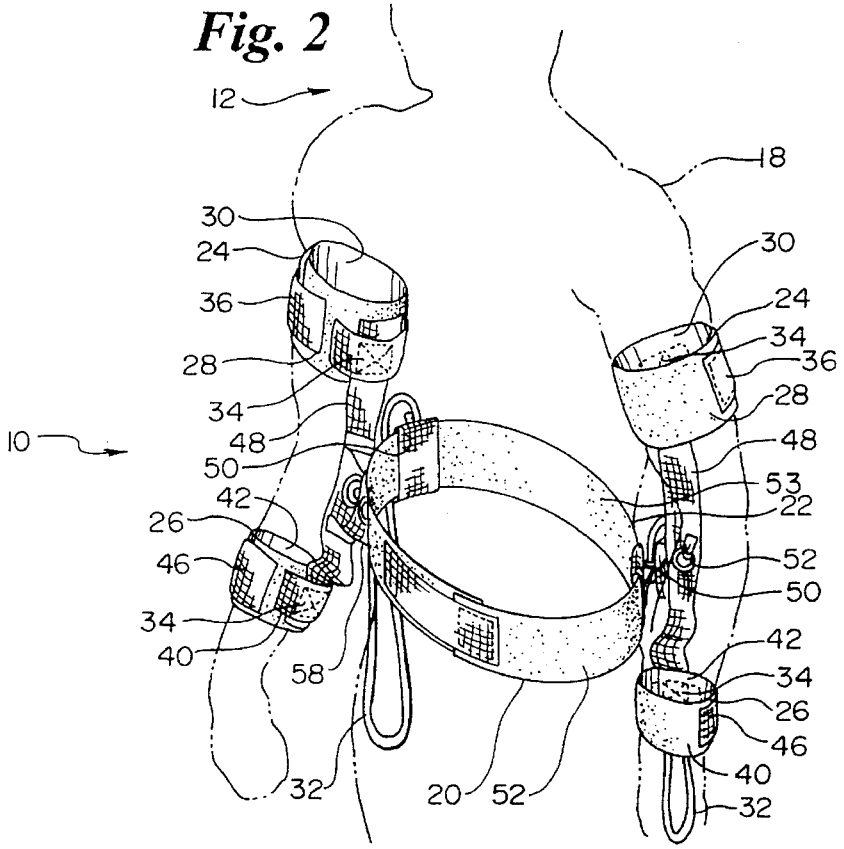
FIG. 2 is a perspective view of a device as shown in FIG. 1 in place on a subject (shown in phantom).
Figure 3:
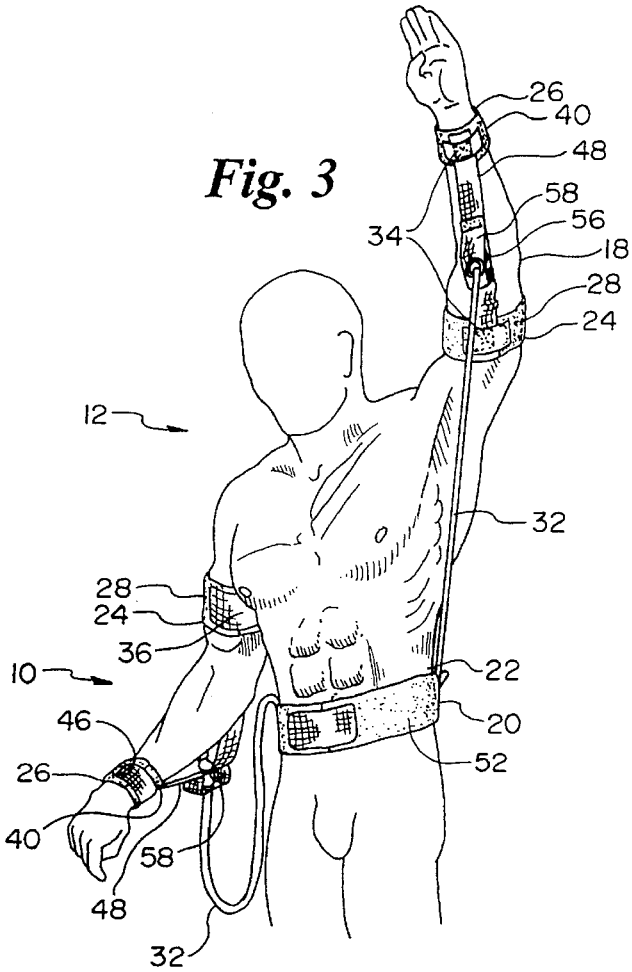
FIG. 3 is similar to FIG. 2, showing the arm fully extended in resistance against the attached belt.

FIGS. 1, 2 and 3 show an embodiment of device 10 of the present invention to be worn entirely by subject 12, showing the structural elements of two sets of arm bindings 14 for attachment to arms 18, and belt 20 for attachment to waist 22. FIGS. 2 and 3 show subject 12 with device 10, as illustrated in more detail in FIG. 1, attached to each arm 18 by means of set of arm bindings 14 comprising upper arm binding 24 and lower arm binding 26. Upper arm binding 24 preferably comprises a padded band for adjustably and closely but comfortably encircling upper arm 18 of subject 12. Upper arm binding 24 is preferably formed on exterior 28 with a stretch fabric, such as SPANDEX expandable fabric and on interior arm-confronting side 30 with a foam padding. Upper arm binding 24 may be secured to arm 18 of subject 12 by any suitable means. One end of upper arm binding 24 may be provided with VELCRO reusable closure 36 to securely fasten upper arm binding 24 in position on subject 12.

Lower arm binding 26 is formed similarly to upper arm binding 24. Lower arm binding 26 is preferably formed on exterior 40 with a stretch fabric, such as SPANDEX expandable fabric and on interior arm-confronting side 42 with a foam padding. Lower arm binding 26 may be secured to arm 18 of subject 12 by any suitable means. One end of lower arm binding 26 may be provided with VELCRO reusable closure 46 to securely fasten lower arm binding 26 in position on subject 12.

Figure 4:
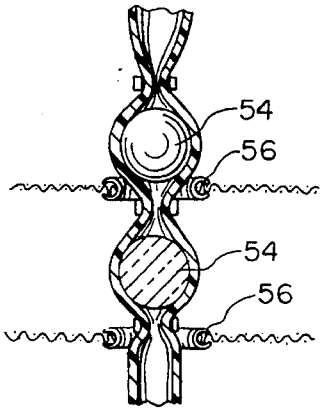
FIG. 4 is a cut-away profile, taken along line 4—4 of FIG. 1, showing attachment of the cord to the connection means of the arm bindings by means of over-size spheres and constricting grommets.

Upper and lower arm bindings 24, 26 may be attached to each other by any suitable means. As shown in FIGS. 1, 2 and 3, they may be attached to each other by means of connector web 48 of sufficient length to accommodate subjects 12 of different heights and arm dimensions to allow for ease of motion and arm extension. Ends of connector web 48 are attached to upper and lower arm bindings 24, 26, respectively, by tack stitching 34. Each connector web 48 is attached to a length of elongated elastomeric and stretchable tether 32 of sufficient length to provide ease of motion while also providing sufficient resistance. As shown in FIGS. 2, 3 and 4, connector web 48 may preferably be attached to tether 32 by over-sized spheres 54 positioned within surgical tubing between constricting grommets 56 secured to connector web 48. To prevent excessive wear on connector web 48, a second portion of webbing 58 may be tack stitched to connector web 48 and provided with another grommet 56 to further support attachment to tether 32. Tether 32 should exhibit such desirable physical properties as flexural yield strength, flexural elastic modulus, tensile strength, elongation and elastic recovery. According to the presently preferred embodiment, polyurethane surgical tubing has been found to be suitable under actual extended use conditions.

Each tether 32 is attached by position adjustable means 50 to waist belt 20. Belt 20 is preferably formed on exterior 52 with a stretch fabric, such as SPANDEX expandable fabric and on interior waist-confronting side 53 with a foam padding. Belt 20 may be secured to waist 22 of subject 12 by any suitable means. One end may be provided with VELCRO reusable closure 46 to securely fasten belt 20 in position on subject 12.

Figure 5:
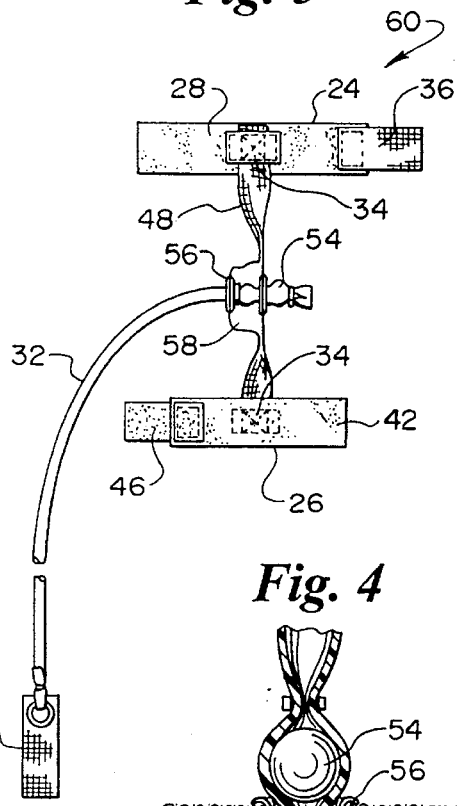
FIG. 5 illustrates an alternative embodiment of the device of the present invention, showing a single set of arm bindings for attachment to a single arm, with an attached tether to be restrained exterior to the subject.
Figure 6:
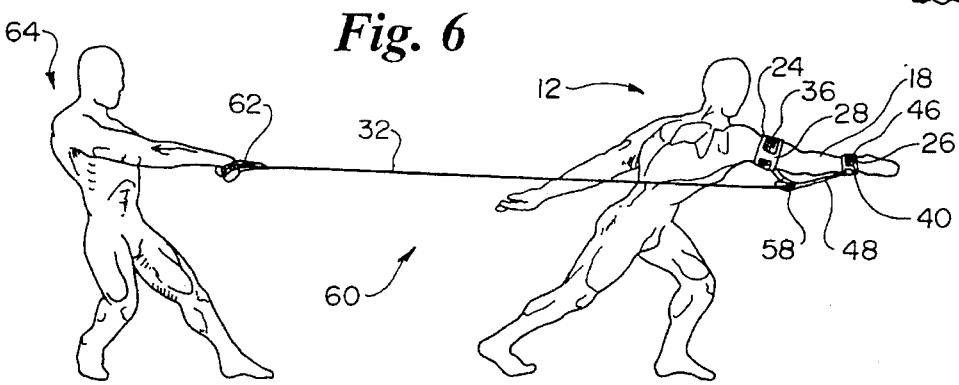
FIG. 6 shows the device of FIG. 5, showing the tether restrained by a trainer.

FIG. 5 illustrates an alternative arm training device 60 of the present invention, showing a single set of arm bindings 14 for attachment to a single arm 18 of a subject 12, with an attached tether 32 to be restrained away from subject 12. FIG. 6 shows the alternative device 60 of FIG. 5, showing the tether 32 restrained by a trainer. Upper and lower arm bindings 24, 26 are formed and attached to each other by connector web 48 as described above. Tether 32, instead of being attached on subject 12, is provided at its end distal to arm binding 14 with loop 62 or similar means for attachment to a restraint against which subject 12 can exert stretching, reaching or throwing action with arm 18. As shown in FIG. 6, the restraint may conveniently be provided by trainer 64 holding loop 62.

According to the present invention, the method of using the inventive device for strengthening and training one or both arms comprises the following steps. Using training device 10, sets of arm bindings 24, 26 are secured to each arm 18 of subject 12 and belt 20 is secured to the waist 22. Subject 12 then provides throwing, stretching or reaching exertion in place. To use alternative training device 60, single set of arm bindings 24, 26 are secured to arm 18 of subject 12 and tether 32 is attached to a restraint means away from subject 12, such as trainer 64. Subject 12 then provides single handed throwing, stretching or reaching exertion in place.

SINGLE ARM TRAINING DEVICE

The following review of the six phases of throwing explains what muscles are trained and developed by the present single arm training device, illustrated in FIG. 6. In this description, the model is a right-handed baseball pitcher.

1. Wind-Up—The wind-up places the athlete in the proper position to initiate the throw. The athlete is positioned with the lead leg (i.e. left leg for a right handed thrower) closest to the target and with both hands together in front of the chest. Weight is shifted onto the right leg as the lead leg is lifted. The wind-up ends as the glove hand separates from the ball and throwing hand. During the wind-up, no tension is placed on the present single arm training device and no loading of any muscles occurs at this time.

2. Stride—As the hands swing apart and up, the lead leg strides towards home plate. Swinging of the arms and striding of the lead leg stores elastic energy by prestretching the muscles of the trunk. The stride ends as the ball of the foot contacts the ground. As the lead leg strides forward, the right external oblique, left internal oblique, left erector spinae, right serratus anterior, right pectoralis major, right anterior deltoid and right coracobrachialis are prestretched and eccentrically loaded as the hips rotate and the shoulders remain in a side-facing direction. At this point, the pull of the present single arm training device prevents the throwing shoulder and arm from rotating too early and this places an added eccentric load on the trunk muscles mentioned above.

3. Arm Cocking—During this phase, the athlete rotates his or her shoulders to face the target. The hips rotate first followed by rotation of the shoulders. Rotation of the hips before the trunk is important because it serves to stretch the muscles across the chest, eventually causing these muscles to contract more forcefully. This prestretching of the trunk muscles enables the trunk to rotate rapidly. As the hips and shoulders rotate, the throwing arm externally rotates at the shoulder and flexes at the elbow. The shoulder and arm are now eccentrically loaded to finish arm cocking and initiate arm acceleration. The arm cocking phase ends when the arm has reached maximum external rotation. The pull of the present single arm training device helps to bring the arm back into maximal external rotation, and as the arm rotates to maximal external rotation, the internal rotators are prestretched and loaded eccentrically in preparation for arm acceleration.

4. Arm Acceleration—At this point, the body begins a series of rapid uncoilings that releases the stored elastic energy which initiates the powerful whipping action of the throw. As maximal external rotation is reached, the arm begins to extend at the elbow followed immediately by the onset of internal rotation at the shoulder. The throwing arm remains abducted 90 degrees throughout the delivery, implying that this is a biomechanically strong position for the shoulder. Arm acceleration ends when the ball is released. Once the elbow is in line with the shoulder, the load of the present single arm training device is transferred from the horizontal adductors to the internal rotators and elbow extensors. This loading transfer ability makes the present single arm training device different from any other currently available upper body training device.

5. Arm Deceleration—After the moment of release, the arm continues to extend at the elbow until full extension is almost reached. Internal rotation continues until approximately a zero degree position. The muscles about the shoulder and elbow contract eccentrically to decelerate the arm and prevent joint distraction. Arm deceleration ends when the arm stops internally rotating at the shoulder.

6. Follow-Through—In this phase, the large muscles of the trunk and legs help reduce deceleration loads on the throwing arm. The follow-through ends when the athlete regains a balanced position and is ready to continue play. No loading by the present single arm training device occurs at this stage; in fact, the present single arm training device helps to slow down these primary motions of throwing.

The present single arm training device enhances performance while reducing the chance of injury like no other training device currently available. Because the motions of throwing are simulated against resistance, there is increased motor learning of this skill. The continued repetition of this action under resisted conditions develops a motor engram which can be automatically and powerfully reproduced. Moreover, evidence suggests that it is more beneficial to learn an action as a whole movement rather than to break it down into isolated parts as many traditional weight training exercises attempt.

Proper throwing mechanics are considered to increase arm and hand speed, to increase projectile velocities, and to decrease the possibility of arm injuries. As the athlete becomes more skilled, efficient use of the muscles takes place, preventing overuse injuries such as muscle strains, tendinitis, and impingement syndromes. With use of the present arm training device, there is reduced risk of injury to the rotator cuff because the tension of the present arm training device helps to decelerate internal rotation and elbow extension while aiding in the prevention of glenohumeral and elbow joint distraction during the follow through, thereby reducing the strain placed upon the infraspinatus and teres minor. Once an athlete adapts to an imposed demand, the resistance must be progressively increased if he or she wishes to improve strength gains.

Because the present single arm training device trains all the muscles involved in the kinetic chain simultaneously, workouts are shorter in duration and less time is devoted to training muscles in isolation. Such specific training decreases the number of exercises needed to stimulate the involved muscles.

Although the baseball pitch was used as model herein, the present single arm training device can be utilized to train and develop throwing motions in other sports such as football, softball, and field events. In such instances, special adaptations are made due to differences in technique and projectile weight.

TWO ARM TRAINING DEVICE

The two arm training device of the present invention, illustrated in FIGS. 1–3, can be used to increase a swimmer's efficiency by increasing the effectiveness of the entry, stretch, catch, and recovery in each of four competitive strokes—freestyle, butterfly, backstroke and breaststroke. Although the entry, stretch, catch, and recovery are not propulsive phases of the swimming stroke, proper technique is vital to having an efficient and effective swimming stroke.

Freestyle Stroke

The extensible tubing of the two arm training device allows for isotonic loading of certain muscles during specific phases of the freestyle. The following review of the freestyle will describe in detail what muscles are trained and developed with the two arm training device.

1. Entry—The entry is made directly in front of the shoulder with the palm turned out 30 to 40 degrees so the thumb enters the water first. This allows the fingertips to slip into the water with minimal drag. The point of entry is approximately three fourths as far in front of the shoulder as could be reached by a completely extended arm. From the point of mid-recovery where the hand passes the shoulder to the point of entry, the two arm training device loads the triceps and anconeus as the elbow extends and the hand reaches for entry.

2. Stretch—After the hand enters the water, the swimmer's arm is extended almost directly forward just beneath the surface. The palm rotates down as the arm continues to extend forward. The stretch should be timed so the stretching arm is nearing complete extension as the other arm finishes its underwater stroke. As the hand stretches forward and feels for the catch, the triceps and anconeus continue to be loaded by the two arm training device as the elbow nears complete extension.

3. Catch—The catch is made precisely as the other arm releases pressure on the water. The wrist is flexed downward approximately 40 degrees and rotated outward. The elbow begins to flex at this point and signals that the most propulsive phases of the underwater armstroke are about to begin. At the time the catch is made, the tension of the two arm training device is at its peak with the load placed upon the elbow extensors. From this point, into the downsweep, and on through the insweep and upsweep, the pull of the two arm training device lessens as the arm goes through the three propulsive phases of the stroke.

4. Downsweep—After the catch, the hand sweeps downward and outward in a curvilinear path. The elbow is gradually flexed during the downsweep to keep the hand moving in a downward direction. The palm is pitched downward, outward, and backward during the downsweep. Beginning with this phase, the tension on the two arm training device lessens and no load is placed upon the propulsive muscles, namely the shoulder extensors, adductors, and internal rotators.

5. Insweep—As the hand approaches its deepest point, the downsweep is rounded off into the insweep. The palm changes pitch to face inward, upward, and backward as the hand sweeps under the body from a position outside the shoulder to one near or beyond the midline. The elbow gradually flexes during this phase until it is flexed approximately 90 degrees when the hand is under the chest. Again, as in the downsweep, no loading of any of the propulsive muscles occurs.

6. Upsweep—Near the completion of the insweep, the swimmer makes an abrupt change of hand direction and sweeps it backward, outward, and upward. The transition takes place when the hand is below the chest and the swimmer begins to push almost directly backward from chest to hips. Pressure is released as the hand approaches the thigh and the palm is rotated inward so it can slide out of the water and into the recovery with minimal drag. Once again, as in all the propulsive phases, no tension is placed on the two arm training device and the propulsive muscles are not loaded.

7. Recovery—A high elbow recovery places the arm in position for another stroke without wasting effort or disturbing body alignment. While the hand is completing the upsweep, the elbow breaks the surface of the water in a slightly flexed position. The elbow moves upward and forward, leading the forearm and hand out of the water. When the hand passes the shoulder, the swimmer begins to extend the arm and reach forward for entry.

The primary actions of the first half of the recovery phase are elbow flexion and shoulder abduction and external rotation. Once the elbow breaks the surface of the water, the biceps and brachialis are loaded as the elbow begins to flex. Also, the middle and posterior deltoids, supraspinatus, infraspinatus, and teres minor are loaded by the tension provided by the two arm training device as these muscles begin to abduct and externally rotate the arm. The middle deltoid acts as an abductor; the posterior deltoid and supraspinatus function as both abductors and external rotators; and, the infraspinatus and teres minor are primarily external rotators.

Once the hand passes the shoulder, the load is transferred from the abductors, external rotators, and elbow flexors to the elbow extensors as the triceps and anconeus fire. The two arm training device has the unique ability to transfer the load from one muscle group to another.

During recovery, the serratus anterior is loaded by the two arm training device as it contracts to allow the acromion to rotate clear of the abducting humerus and provides a stable glenoid on which the arm may rotate as in throwing. It is vital that the acromion rotate clear of the humerus or else an impingement syndrome may result. By loading and strengthening the serratus anterior, the endurance of this muscle will improve, and the chance of this muscle fatiguing and allowing impingement is reduced.

Butterfly Stroke

The armstroke of the butterfly is very similar to that of the crawl stroke except both arms stroke simultaneously rather than alternately as in the crawl stroke. The following review of the phases of the butterfly will describe what muscles are developed with the use of the two arm training device of this invention.

1. Entry—The hands enter the water in front of the shoulders simultaneously with the palms pitched outward approximately 45 degrees. The elbows should be slightly flexed upon entry so that the elbows can begin to extend immediately after entry while the upper arms continue to travel inward. This action overcomes the inward inertia the hands develop during the recovery and provides a smooth transition to the outsweep. At the point of entry, the elbows are beginning to extend and the tension provided by the two arm training device overloads the triceps and anconeus. No other muscle groups are being trained at this time.

2. Outsweep—After entry, extension of the elbows starts the hands moving outward in a curvilinear path until the hands pass shoulder width. The fingertips lead this motion with the palms pitched outward and backward. The outsweep is quite short and not significantly propulsive. Mainly, it is a gentle, stretching action that positions the hands for the catch and the propulsive insweep. During this phase, the elbows continue to extend and the triceps and anconeus continue to be loaded by the two arm training device.

3. Catch—The catch is made as the hands pass outside shoulder width. The pitch of the hands changes from outward and backward to outward, downward, and backward. The elbows gradually begin to flex at this time to help make a strong catch. Because the elbows begin to flex at this time, the tension of the two arm training device lessens, placing no stress on any muscles.

4. Downsweep—After the catch is made, the hands sweep down and out in a circular path. The downsweep ends when the hands approach the deepest point of the stroke. During this first propulsive phase, the tension of the two arm training device continues to decrease and no loading occurs.

5. Insweep—The insweep begins as the hands pass under the elbows at the deepest point of the stroke. From this point, the hands sweep inward, upward, and backward in a semicircular movement that is accomplished by continued elbow flexion. The insweep ends when the hands are below the head near the body's midline. The elbows are flexed approximately 90 degrees at this time. The insweep is a powerful propulsive movement where the hands are accelerated from beginning to end. Here again, the two arm training device does not provide tension and none of the propulsive muscles are stressed.

6. Upsweep—From the end of the insweep, the hands change direction from inward, upward, and backward to backward, outward, and upward. Once this change of direction is completed, the hands continue sweeping back, out, and up until they reach the anterior thighs, where the release is made. The upsweep is the most powerful, propulsive phase of the butterfly. At this point, the two arm training device is slack, and, once again, none of the propulsive muscles, namely the shoulder extensors, adductors, and internal rotators in conjunction with the elbow extensors, are loaded.

7. Recovery—The elbows break through the surface of the water while the hands are still completing the upsweep. When the upsweep ends, the water is released, and the palms are turned inward to allow the hands to follow the arms up and outward over the water. The arms continue moving outward and upward until they pass the shoulders, at which time the motion becomes inward and forward until the entry is made. During the first half of the recovery, the arms are abducted and the elbows extended. At this time, the two arm training device progressively becomes more taunt and overloads the deltoids, supraspinatus, triceps, and anconeus.

After the arms pass the shoulders, the second half of the recovery begins as the elbows flex slightly and the hands reach forward for entry. At this point the elbow extensors are unloaded and the two arm training device loads only the shoulder abductors. However, once the arms pass the shoulders, the clavicular portion of the pectoralis major fires to aid abduction and becomes loaded by the two arm training device. Also, the serratus anterior is loaded throughout the recovery as it contracts to keep the scapula in line with the abducting humerus.

Backstroke

The backstroke consists of an alternating armstroke. The swimmers are supine which forces them to stroke to the sides rather than directly below the body. The following review of the six phases of the backstroke, will explain exactly how the muscles are trained and developed by the two arm training device of this invention.

1. Entry—The entry is made with the elbow completely extended and directly forward of the shoulder. The hand enters little finger first with the palm facing outward so it can slice into the water without creating excessive turbulence. At the point of entry, maximum tension is placed upon the two arm training device, and the anterior deltoid, clavicular portion of the pectoralis major, short head of the biceps brachii, and the coracobrachialis are loaded as they flex the shoulder forward and upward. Also, the triceps and anconeus are loaded as they contract to stabilize complete elbow extension.

2. First Downsweep—After entry, the hand sweeps down and out to the catch position. During this phase, the shoulders and hips roll toward the arm to facilitate this downward sweep by bringing the large trunk muscles into action. The catch is made at nearly the deepest and widest point of the stroke. When the catch is made, the elbow is flexed slightly in preparation for the propulsive sweep that follows. Although this first downsweep is not propulsive, it is vital in placing the arm in position to apply propulsive force. As the arm sweeps outward, downward, and backward while the elbow begins to flex, the tension of the two arm training device lessens and the load placed upon the muscles mentioned above is reduced. However, the muscles of the posterior shoulder, namely the posterior deltoid, infraspinatus, teres minor, and rhomboids are loaded as the arm sweeps downward.

3. First Upsweep—After the catch is made during the first downsweep, the arm is swept upward, inward, and backward in a curvilinear path until the hand is in line with the shoulder and near the surface. At this point, the elbow is flexed approximately 90 degrees. The palm rotates up and in while it is being brought toward the surface. This phase is the first propulsive phase of the backstroke. As the hand sweeps inward, upward, and backward, the tension of the two arm training device lessens even more and no loading of any of the propulsive muscles occurs.

4. Second Downsweep—As the hand nears the surface, the swimmer begins sweeping it backward and downward in a circular path. The palm gradually rotates downward and outward during the transition from the first upsweep to the second downsweep. This phase ends when the elbow is completely extended and well below the thigh. Hand speed decreases during the transition, but then accelerates until the hand is moving at its maximum speed when this sweep ends. At this point, the hand is moving backward and downward, and the two arm training device becomes slack. Again, no strengthening of any of the propulsive muscles occurs through use of the two arm training device.

5. Second Upsweep—After the preceding downsweep, the hand is swept up, back, and in until it reaches the rear thigh. At this point, the recovery begins and no more propulsion occurs. During this phase, the wrist is hyperextended and the palm is facing backward and upward. Not all swimmers utilize this second upsweep. Many begin recovering their arms after the second downsweep is completed. The two arm training device remains slack during this phase and no muscles are loaded.

6. Recovery—After the second upsweep, the swimmer releases pressure on the water and turns the palm inward so the hand can slip out of the water on edge with minimal resistance. Continued rolling of the shoulders allows the swimmer to synchronize the vertical recovery of one arm with the pull of the other. Once the hand and arm leave the water, the tension of the two arm training device increases and the shoulder flexors are gradually loaded as the arm moves upward and forward towards entry. In addition, the triceps and anconeus are loaded as they statically contract to stabilize full elbow extension. Moreover, as the hand passes overhead and the palm turns outward, the internal rotators of the shoulder, such as the subscapularis, latissimus dorsi, teres major, and shoulder flexors, are loaded and strengthened. The serratus anterior becomes loaded throughout the recovery and entry as it stabilizes the scapula and provides a platform on which the humerus can rotate.

Breaststroke

The following review of the phases of the breaststroke will reveal how the two arm training device of this invention loads and develops certain muscles involved with this stroke.

1. Outsweep—During this phase, the arms sweep directly outward beyond shoulder width with the palms pitched out and back. The elbows are extended during most of the outsweep. Since the outsweep is not propulsive, swimmers sweep the hands out slowly and gently. As the hands sweep outward, the pull of the two arm training device loads the triceps and anconeus as they statically contract to stabilize elbow extension. In addition, the latissimus dorsi, teres major, and sternal portion of the pectoralis major are slightly loaded as the shoulder begins to adduct the arm.

2. Catch—Once the hands pass shoulder width, the elbows flex slightly and the catch is made. At this point, the palms change pitch from outward and backward to outward, downward, and backward. This change in pitch creates a lift force which causes the head and shoulders to surge forward over the arms. When the catch is made, the elbows begin to flex and the pull of the two arm training device is lessened, thus the load placed on the muscles mentioned above is reduced.

3. Downsweep—Once the catch is made, the hands sweep downward and outward in a circular path until they reach the deepest point of the stroke. The hands face outward and downward throughout the downsweep as they accelerate from beginning to end. During this first propulsive phase, the tension of the two arm training device is further reduced and no loading of any muscles occurs.

4. Insweep—At the deepest point of the stroke, the hands sweep inward, upward, and backward in a circular path. The pitch of the hands changes from outward and downward to inward and upward throughout the insweep. The insweep ends as the hands come together with the elbows flexed more than 90 degrees. The two arm training device is slack during this most propulsive phase of the breaststroke, and no load is placed upon any of the propulsive muscles.

5. Recovery—The recovery begins when the hands are close together under the swimmer's chin. The hands release their pressure on the water while the inward and downward motion of the elbows starts the hands forward into the recovery. The palms are quickly rotated downward as the hands move forward. As the elbows squeeze together to initiate the forward recovery of the hands, the triceps and anconeus are loaded by the two arm training device as the elbows extend the forearms straight ahead. In addition, the shoulders begin to flex at this time, and the anterior deltoid, biceps, coracobrachialis, and clavicular portion of the pectoralis major become loaded by the two arm training device.

The following advantages may be noted while training with the two arm training device of this invention.

* Correction of muscle imbalances

Most of the injuries that swimmers develop are chronic overuse injuries and instabilities that result from muscle imbalances. For example, all of the four competitive strokes rely on the motions of shoulder adduction, extension and internal rotation, and, because of this, the muscles that perform these motions become overdeveloped while the muscles that perform shoulder abduction and external rotation are neglected and become underdeveloped.

These weaker muscles, namely the supraspinatus, infraspinatus, and teres minor, are the primary muscles loaded by the two arm training device during the freestyle and butterfly strokes. By loading these posterior shoulder muscles with the two arm training device, muscular imbalances, which cause instabilities and overuse syndromes, can be corrected.

* Speed specific training at competition speeds

In order to swim faster, swimmers must train themselves neuromuscularly to generate muscular force at fast arm speeds. Traditional dry land weight training exercises cannot accomplish this because these exercises must be performed at slow speeds or else musculotendinous injury may result. This contradicts the high speed nature of the four competitive strokes. However, with the two arm training device of this invention, the arms can be moved at speeds of 240 to 300 degrees per second, speeds similar to those performed in competition.

* Development of lean, functional muscle rather than excessive bulk

Traditional dry land exercises may cause hypertrophy of inappropriate muscles which will decrease buoyancy and efficiency of motion. When muscle bulk is increased to a point where flexibility decreases, swimming speed also decreases. However, the present two arm training device strengthens only the appropriate muscles in such a way that excessive hypertrophy does not result. This occurs because high reps at relatively low resistance levels are performed with the two arm training device. Such a combination of reps and resistance develops only strength, endurance, and neuromuscular pathways and does not increase the cross section of muscle fibers. Thus, short, bulky muscles that decrease buoyancy, increase drag, and restrict movement are not developed by the two arm training device of this invention.

* Improved time management

Because the strengthening is performed in the pool while swimming, the need for additional dry land exercises to stimulate the appropriate muscles is no longer required. In addition, the two arm training device allows for unrestricted movement in the pool. Rotation of the hips and rolling of the shoulders is not inhibited with the two arm training device as it is with traditional hand paddles and pull buoys. Moreover, the two arm training device can be used during starts, turns, and, for extremely intense sets, in conjunction with hand paddles and pull buoys. Thus, a shorter workout can result in increased intensity and quality of training.

* Progressive overload capability

The tension of the two arm training can be increased to meet the demands of increased strength and power. This allows for continued improvement by the ability to further overload the appropriate muscles.

* Correction of recovery and entry errors

The pull of the two arm training device helps correct certain mistakes commonly seen during the entry and recovery phases of the four competitive strokes. Entry problems, such as overreaching in the freestyle and backstroke are eliminated because the pull of the two arm training device prevents swimmers from performing such unnecessary motions. Also, the pull of the two arm training device prevents a rushed recovery in all of the competitive strokes and prevents the use of a wide, low or hand-in-the-sky recovery during the freestyle and butterfly.

Although the swimmer was used as model herein, the present two arm training device can be utilized to train and develop two-handed reaching and pulling motions in other sports. For example, the two arm training device may be worn during training for sports involving vigorous exertion of both arms, such as hockey. Further, the two arm training device may be modified by having the tethers of both arms connected to resistance external to the athlete, such as being held by a trainer or attached to a stationary resistance, for sports such as canoeing, sculling, rowing and kyacking.

The single and the two arm training devices of the present invention provide athletes the opportunity to simulate the specific skills of their sports under ballistic and resistant conditions. Use of the present arm training device allows complete neuromuscular training for these reasons. Sport skills can be exactly duplicated. Exercises can be performed at very fast contractile speeds, similar to those used in competition. The involved muscles can be progressively overloaded, since resistance can be increased over that encountered in competition and can be continually increased as power improves.

What is claimed is:

1. A single arm training device for strengthening and training only a single arm of a person comprising:

a single resilient and extensible elongate tether having first and second ends;

a single set of arm bindings, the set of arm bindings comprising a separate and independent upper arm binding for attachment to an upper arm of the person and a separate and independent lower arm binding for attachment to a lower arm of the person, the arm bindings having a connection to each other, such that the connection is secured to the first end of the tether; and restraint connected to the second end of the tether, configured to allow attachment of the restraint to a resistance external to the person, as a sole means of resistance for the device.

2. An arm training device according to claim 1, wherein the upper arm binding comprises a band for encircling an upper arm with means for retaining the band thereabout, and wherein the lower arm binding comprises a band for encircling a lower arm with means for retaining the band thereabout and wherein the restraint provides resistance for the arm moving or exerting motion away from the means of resistance.

3. An arm training device according to claim 1, wherein the restraint means is a position adjustable closed loop.

4. A two arm muscle training device for strengthening and training both arms of a person comprising:

two stretchable and retractile elongate cords of elastic resinous material characterized by a property of elongating from a resting length under influence of a pulling force thereon and returning to the resting length upon release of the pulling force, each the cord having first and second ends;

two sets of arm bindings, each set of arm bindings further comprising a separate and independent upper arm binding and a separate and independent lower arm binding for securing to upper and lower arm, respectively, of an arm of the person, the arm bindings of each set having connection to each other, such that each connection is secured to the first end of each of the cords; and the second end of each of the cords secured to a waist band, the waist band adapted and designed to be positioned around the person's waist to provide restraint and resistance for the person's arms moving or exerting motion away from the waist band positioned around the person's waist.

5. An arm muscle training device according to claim 4, wherein the upper arm binding comprises an adjustable band for encircling an upper arm with means for securely and releasably retaining the band thereabout, and wherein the lower arm binding comprises an adjustable band for encircling a lower arm with means for securely and releasably retaining the band thereabout.

6. A two arm training device for strengthening and training both arms of a person consisting of:

two sets of arm bindings, each set of arm bindings comprising a separate and independent upper arm binding for attachment to an upper arm of the person and a separate and independent lower arm binding for attachment to a lower arm of the person, the arm bindings of each set having a connection to and between each other;

two resilient and extensible elongate tethers, each having first and second ends, such that each connection is secured to a first end of each tether; and a restraining waistband, having the second end of each tether attached to the waistband;

such that each tether is of a length to provide, fully extended, maximum resistance to each respective arm, fully extended, against the waistband positioned around a waist of the person.

7. A two arm training device according to claim 6, wherein each upper arm binding has a band for encircling an upper arm of the person with means for retaining the band thereabout, and wherein each lower arm binding has a band for encircling a lower arm of the person with means for retaining the band thereabout.

8. A single arm muscle training device for strengthening and training only a single arm of a person consisting of:

a single stretchable and retractile elongate cord of elastic resinous material characterized by a property of elongating from a resting length under influence of a pulling force thereon and returning to the resting length upon release of the pulling force, the cord having first and second ends;

a single set of arm bindings, the set of arm bindings having a separate and independent upper arm binding for securing to an upper arm of the person and a separate independent lower arm binding for securing to a lower arm of the person, the arm bindings further having connection to and between each other, such that the connection is secured to the first end of the cord, and restraint means connected to the second end of the cord, configured for attachment to resistance means external to the person, as the sole resistance for the device.

9. A single arm muscle training device according to claim 8, wherein the upper arm binding has an adjustable band for encircling an upper arm of the person with means for securely and releasably retaining the band thereabout, wherein the lower arm binding has an adjustable band for encircling a lower arm of the person with means for securely and releasably retaining the band thereabout, and wherein the resistance means provides resistance for the arm moving or exerting motion away from the resistance means.

10. A single arm training device for strengthening and training only a single arm of a person comprising:

a single resilient and extensible elongate tether having first and second ends;

a single set of arm bindings, the set of arm bindings comprising a separate and independent upper arm binding for attachment to an upper arm of the person and a separate and independent lower arm binding for attachment to a lower arm of the person, the arm bindings having a connection to each other, such that the connection is secured to the first end of the tether; and restraint connected to the second end of the tether, configured to allow attachment of the restraint to an adjacent resistance as the sole resistance for the device.

11. A method for strengthening and training only a single arm of a person using a device according to claim 1, whereby:

the upper arm binding is secured to the upper arm of the person and the lower arm binding is secured to the lower arm of the person;

the restraint is attached to an adjacent resistance; and the person moves or exerts motion of his or her arm by fully extending the arm against the resistance with maximum elongation of the cord.

12. A method for strengthening and training two arms of a person using a device according to claim 4, whereby:

each upper arm binding of a set of arm bindings is secured to each upper arm of the person, and each lower arm binding of each set of arm bindings is secured to each lower arm of the person; and the person moves or exerts motion both of his or her arms by fully extending the arms against the restraint with maximum elongation of each cord.

13. A method for strengthening and training both arms of a person using the device according to claim 6, wherein:

each upper arm binding of each set of arm bindings is secured to each upper arm of the person, and each lower arm binding of each set of arm bindings is secured to each lower arm of the person;

the restraining waist band is positioned around the waist of the person; and the person moves or exerts motion of both of his or her arms by fully extending the arms against the restraining waistband with maximum elongation of each tether.

14. A method of strengthening and training only a single arm of a person using the device according to claim 8, wherein:

the upper arm binding is secured to an upper arm of the person and the lower arm binding is secured to an lower arm of the person;

the restraint is attached to resistance means external to the person as the sole resistance for the device; and the person moves or exerts motion of his or her arm by fully extending the arm against the means of resistance with maximum elongation of the cord.

15. A method for strengthening and training only a single arm of a person using the device according to claim 10, wherein:

the upper arm binding is secured to an upper arm of the person and the lower arm binding is secured to a lower arm of the person;

the restraint is attached to an adjacent resistance as the resistance for the device; and the person moves or exerts motion of his or her arm by fully extending the arm against the means of resistance with maximum elongation of the tether.

* * * * *

UNITED STATES PATENT AND TRADEMARK OFFICE

CERTIFICATE OF CORRECTION

PATENT NO. : 5,518,480

DATED : May 21, 1996

INVENTOR(S) : John P. Frappier

It is certified that error appears in the above-indentified patent and that said Letters Patent is hereby corrected as shown below:

Column 14, line 32, delete "an" and insert therefor --a--

Signed and Sealed this

Twelfth Day of November, 1996

*Attest:*

Bruce Lehman

BRUCE LEHMAN

*Attesting Officer*

*Commissioner of Patents and Trademarks*